US005255856A

United States Patent [19]

Ishibashi et al.

[11] Patent Number: 5,255,856

[45] Date of Patent: Oct. 26, 1993

[54] ELECTROSTATIC SPRAY PAINTING APPARATUS

[75] Inventors: Ichirou Ishibashi; Nobunari Arai; Toshio Kubota, all of Sayama, Japan

[73] Assignee: Honda Giken Kogyo Kaubshiki Kiasha, Tokyo, Japan

[21] Appl. No.: 778,269

[22] Filed: Oct. 17, 1991

[30] Foreign Application Priority Data

| | | | |
|---|---|---|---|
| Nov. 8, 1990 | [JP] | Japan | 2-304465 |
| Jan. 23, 1991 | [JP] | Japan | 3-001690[U] |
| Feb. 20, 1991 | [JP] | Japan | 3-007561[U] |

[51] Int. Cl.[5] ..... B05B 5/16

[52] U.S. Cl. ..... 239/691; 239/690; 361/228; 118/629

[58] Field of Search ..... 239/690, 691, 92, 112; 361/227, 228; 118/302, 621, 629; 417/392; 92/157-159, 174

[56] References Cited

U.S. PATENT DOCUMENTS

| | | | |
|---|---|---|---|
| 323,749 | 8/1885 | Stitzel | 92/158 |
| 3,536,580 | 10/1970 | La Fave . | |
| 4,771,729 | 9/1988 | Planert et al. . | |
| 4,830,737 | 5/1989 | Cole, Jr. | 417/392 |
| 4,884,752 | 12/1989 | Plummer | 239/112 |
| 4,932,589 | 6/1990 | Diana | 118/302 |
| 5,083,711 | 1/1992 | Giroux et al. | 239/690 |
| 5,094,389 | 3/1992 | Giroux et al. | 239/690 |
| 5,096,126 | 3/1992 | Giroux et al. | 239/690 |
| 5,102,045 | 4/1992 | Diana | 239/112 |
| 5,133,499 | 7/1992 | Schneider . | |

FOREIGN PATENT DOCUMENTS

| | | | |
|---|---|---|---|
| 0283917 | 9/1988 | European Pat. Off. . | |
| 0435005 | 7/1991 | European Pat. Off. | 118/629 |
| 1802693 | 5/1969 | Fed. Rep. of Germany . | |
| 3440381 | 5/1986 | Fed. Rep. of Germany . | |
| 3821006 | 7/1989 | Fed. Rep. of Germany . | |
| 63-310671 | 12/1988 | Japan . | |
| 22885 | 1/1990 | Japan . | |
| 803987 | 2/1981 | U.S.S.R. | 239/112 |
| WO87/05832 | 10/1987 | World Int. Prop. O. . | |

OTHER PUBLICATIONS

JP 57-38 960 (A); Patent Abstracts of Japan, C-109; vol. 6, No. 110 of Jun. 22, 1982.

l'Étanchéité en Mécanique, J. Martin, 1981, C.C.P, Paris, pp. 198-200.

*Primary Examiner*—Andres Kashnikow

*Assistant Examiner*—Christopher G. Trainor

[57] ABSTRACT

An electrostatic spray painting apparatus includes an electrically-insulated intermediate reservoir for storing therein conductive paint to which a high voltage is directly applied. In addition, the intermediate reservoir includes a cylinder, a piston reciprocatively and slidably disposed within the cylinder, and a fluid-flow straightening member protrudently formed in a part of a cylinder chamber used to be charged with the paint. The cylinder chamber is defined by the cylinder and the piston. An injection hole is defined near an outer peripheral edge of a cylinder wall so as to be connected to a paint and cleaning fluid feed source. A discharge hole is centrally defined in the cylinder wall so as to be connected to a spray gun, the discharge hole being used to discharge the paint and the cleaning liquid.

14 Claims, 12 Drawing Sheets

ELECTROSTATIC SPRAY PAINTING APPARATUS

BACKGROUND OF THE INVENTION

1. Field of the Invention

The present invention relates to an electrostatic spray painting apparatus having an intermediate reservoir incorporated therein for temporarily storing therein conductive paint to which a high voltage is directly applied.

2. Description of the Related Art

As one mode, i.e., one functioning arrangement employed in an electrostatic spray painting apparatus, there has heretofore been provided an intermediate reservoir between a spray gun and a paint feed source.

The intermediate reservoir is normally provided with a storage chamber having a given capacity. In addition, the intermediate reservoir is constructed in such a manner that a predetermined quantity of paint can be supplied to a spray gun by a piston reciprocatively movable within the storage chamber.

Many attempts and improvements have been made with a view toward avoiding the mixture of paint prior to color changeover or replacement with the new paint upon the use of the new paint owing to the fact that the previously-used paint remains in the intermediate reservoir and adheres thereto. As one typical example, there can be mentioned a technical idea disclosed in each of U.S. Pat. No. 4,771,729 entitled "SYSTEM FOR AUTOMATIC ELECTROSTATIC SPRAY COATING" and Japanese Patent Application Laid-Open No. 63-310671 entitled "METHOD OF SUCCESSIVELY SPRAY-COATING WORK WITH CONDUCTIVE PAINTING MATERIAL".

According to the former disclosure, however, cleaning liquid is blown toward only an end face of a piston when it is desired to clean the inside of the intermediate reservoir at the time of the color replacement. Therefore, paint prior to the color replacement is not fully removed from a peripheral edge of the piston end face, to which the cleaning liquid is not fully applied.

According to the latter disclosure, the quantity of cleaning liquid flowing in the intermediate reservoir is not sufficient to clean the inside of the intermediate reservoir at the time of the color replacement, with the result that the removal of paint from a piston end face is substantially insufficient.

Even in either case of such two prior disclosures, O-rings are used as sealing members provided between the piston and the cylinder. Therefore, the paint, which has been injected into a cylinder chamber may slightly leak at the time that the paint is fed according to the displacement of the piston.

As a result, some paint remains in an inner peripheral wall of the cylinder chamber and adheres thereto, so that such paint mixes with the new paint, thereby causing the inconvenience that paint of an unadulterated color cannot actually be applied to a workpiece.

In order to overcome the foregoing inconvenience, the piston should be cleaned when withdrawn, thereby causing the problem that the cleaning time of the inside of the intermediate reservoir is time consuming and a large quantity of cleaning liquid is required.

Now, there are situations in which a relatively small quantity of paint may simply be supplied to a spray gun owing mainly to the shape and the dimensions of a portion to which paint is to be applied. It has, however, been pointed out as a problem that even excess paint is stored in a storage chamber of a normally-used intermediate reservoir, resulting in an inefficient cleaning process. Therefore, there has been proposed an apparatus having means for measuring the quantity of paint supplied to an intermediate reservoir, and means for confirming whether or not a predetermined quantity of paint is supplied to the intermediate reservoir. However, this apparatus has the problem that it is complex in structure and expensive as a whole, for example.

On the other hand, there is known a color-of-paint changeover system disclosed in Japanese Patent Application Laid-Open No. 2-2885, for example, as a technique for applying a high voltage to conductive paint so as to subject an object or workpiece to be coated with the paint to electrostatic spray painting or coating.

According to this disclosure, the conductive paint is first introduced via an insulated line into an intermediate reservoir from a paint feed source. Thereafter, the insulated line is cleaned and dried so as to be brought into an electrically-insulated state (voltage block), thereby preventing current from leaking to the paint feed source side. Under this condition, conductive paint to which a high voltage is applied is supplied to a spray gun from the intermediate reservoir, so that the electrostatic spray coating is transferred to the object or workpiece.

In this case, pressurized air has been supplied to the intermediate reservoir from a pressurized-air feed source in order to feed the conductive paint to the spray gun from the intermediate reservoir. After the delivery of the conductive paint to the spray gun is completed, the pressurized air is discharged to the outside from the intermediate reservoir through a vent portion.

In the conventional art referred to above, however, the pressurized air in the intermediate reservoir is adiabatically-expanded so as to be discharged to the outside from the vent portion. Therefore, a path extending from the intermediate reservoir to the vent portion is cooled, thereby condensing moisture or water in the atmosphere into dew. As a consequence, the dew is deposited on the path and the vent portion. Therefore, an undesired flow of electricity can easily occur owing to the deposition of the dew thereon when the high voltage is applied to the conductive paint in the intermediate reservoir.

SUMMARY OF THE INVENTION

It is a principal object of the present invention to provide an electrostatic spray painting apparatus of a type wherein the detergent action on an intermediate reservoir at the time that the present color is replaced by another can be improved, and paint prior to the color replacement can be prevented from remaining in an inner peripheral wall of a cylinder chamber and adhering thereto so as to avoid the mixing of the new paint with the paint prior to the color replacement, thereby making it possible to apply paint of an unadulterated color to a workpiece.

It is another principal object of the present invention to provide an electrostatic spray painting apparatus of a type wherein the quantity of paint to be stored is changed according to a portion to which paint is applied, thereby enabling an efficient paint feeding process and a simplification of its structure.

It is a further principal object of the present invention to provide an electrostatic spray painting apparatus of a type wherein the generation of dew condensation can be prevented by pressurized air delivered from an intermediate reservoir, thereby making it possible to efficiently prevent an undesired flow of electricity upon application of a high voltage to conductive paint.

It is another object of the present invention to provide an electrostatic spray painting apparatus comprising an electrically-insulated intermediate reservoir for storing therein conductive paint to which a high voltage is directly applied, the intermediate reservoir including a cylinder, a piston reciprocatively and slidably disposed within the cylinder, a fluid-flow straightening member protrudently formed in a part of a cylinder chamber used to be charged with the paint, the cylinder chamber being defined by the cylinder and the piston, an injection hole defined near an outer peripheral edge of a cylinder wall so as to be connected to a paint and cleaning liquid feed source, and a discharge hole centrally defined in the cylinder wall so as to be connected to a spray gun, the discharge hole being used to discharge the paint and the cleaning liquid.

It is a further object of the present invention to provide the electrostatic spray painting apparatus wherein the fluid-flow straightening member is mounted on an end face of the piston, the end face constituting an inner wall of the cylinder chamber.

It is a still further object of the present invention to provide the electrostatic spray painting apparatus wherein the fluid-flow straightening member is mounted on a face which constitutes the inner wall of the cylinder chamber and faces the end face of the piston.

It is a still further object of the present invention to provide the electrostatic spray painting apparatus wherein the fluid-flow straightening member has a plurality of crescent-shaped protrusions each having two outer and inner circular arcs extending in the same direction in such a manner that fluid injected from the injection hole makes a vortex flow.

It is a still further object of the present invention to provide the electrostatic spray painting apparatus wherein a cavity to be charged with either water or a mixture of water and glycerin is defined by defining a circumferential groove in a peripheral wall of the piston.

It is a still further object of the present invention to provide the electrostatic spray painting apparatus wherein sealing members made of high-molecular weight resins are mounted on the peripheral wall of the piston, the sealing members each having either a U-shaped cross section or a V-shaped cross section.

It is a still further object of the present invention to provide an electrostatic spray painting apparatus comprising an electrically-insulated intermediate reservoir for storing therein conductive paint to which a high voltage is directly applied, the intermediate reservoir including a cylinder, a piston reciprocatively and slidably disposed within the cylinder, an injection hole defined in a cylinder wall so as to be connected to a paint and cleaning liquid feed source, and a discharge hole defined in the cylinder wall, the discharge hole being used to discharge the paint and the cleaning liquid, and a cavity defined in a peripheral wall of the piston so as to be charged with cleaning fluid.

It is a still further object of the present invention to provide the electrostatic spray painting apparatus wherein the cylinder is vertically disposed in such a manner that the injection hole and the discharge hole extend in a downward direction.

It is a still further object of the present invention to provide the electrostatic spray painting apparatus wherein one end of a hollow piston rod is fixedly secured to the piston, whereas the other end of the hollow piston rod is provided with a tank for storing the cleaning fluid therein, and the cavity of the piston and the tank communicate with each other through the hollow piston rod.

It is a still further object of the present invention to provide an electrostatic spray painting apparatus comprising an electrically-insulated intermediate reservoir for storing therein conductive paint to which a high voltage is directly applied, the intermediate reservoir including a storage chamber filled with the paint from one end side thereof and supplied with air from the other end side thereof, a piston movably disposed in the storage chamber, a rod extending from an end of the piston to an air feed side and projecting from the storage chamber to the outside, a hollow rod fixedly mounted on an outer peripheral wall of the rod, the hollow rod being axially movable relative to the rod, an extension disposed between a cover defining the storage chamber and the piston, the extension being mounted on the hollow rod and engageable with the cover, and means mounted on the rod and the hollow rod, for detecting respective positions where the piston is reciprocatively moved.

It is a still further object of the present invention to provide the electrostatic spray painting apparatus wherein the rod has a screw formed on the outer peripheral wall thereof and the hollow rod has a screw channel defined in an inner peripheral wall thereof so as to be threadedly engaged with the screw.

It is a still further object of the present invention to provide the electrostatic spray painting apparatus wherein the detecting means each include a pair of sensors and a pair of dogs which can be held in engagement with the sensors respectively when the piston reaches its uppermost advanced position and its lowermost withdrawal position.

It is a still further object of the present invention to provide an electrostatic spray painting apparatus comprising an electrically-insulated intermediate reservoir for storing therein conductive paint to which a high voltage is directly applied, a pressurized-air feed mechanism for supplying pressurized air to the intermediate reservoir so as to deliver the paint in the intermediate reservoir to a spray gun, a vent mechanism for discharging the pressurized air to the outside from the intermediate reservoir after completion of the supply of the paint to the spray gun, and a mechanism for preventing the vent mechanism from being subjected to dew condensation.

It is a still further object of the present invention to provide the electrostatic spray painting apparatus wherein the dew-condensation prevention mechanism includes an air feed source for supplying dry air to the outer face of the vent mechanism.

It is a still further object of the present invention to provide the electrostatic spray painting apparatus wherein the dew-condensation prevention mechanism includes a heat insulating material mounted on the outside of the vent mechanism.

It is a still further object of the present invention to provide the electrostatic spray painting apparatus wherein the dew-condensation prevention mechanism includes heating means mounted on the vent mechanism.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 1:
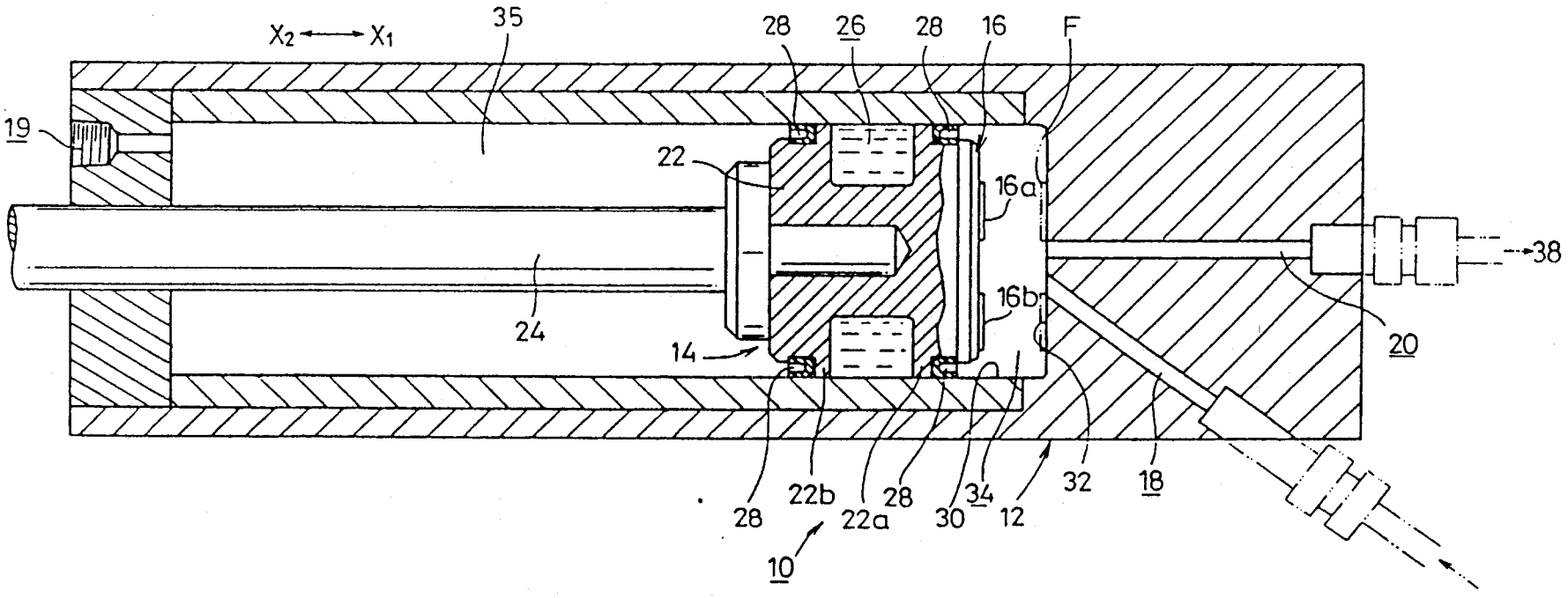
FIG. 1 is a vertical cross-sectional view of an intermediate reservoir of an electrostatic spray painting apparatus according to a first embodiment of the present invention.

Referring to FIG. 1, designated at numeral 10 is an intermediate reservoir of an electrostatic spray painting apparatus according to a first embodiment of the present invention. The intermediate reservoir 10 basically comprises a cylinder 12, a piston 14, a fluid-flow straightening member 16, a hole 18 for the injection of paint and cleaning liquid, a hole 20 for the discharge of the paint and the cleaning liquid.

The piston 14 comprises a piston main body 22 and a piston rod 24. The main body 22 is fixed to the leading end of the piston rod 24. More specifically, it is fixed to the leading end of the piston rod 24, which extends in a direction in which the piston rod 24 moves forward when paint is delivered from the intermediate reservoir 10 to a spray gun 38 to be described later. In addition, the main body 22 has peripheral side portions 22*a*, 22*b* closely held against a cylinder wall 32 of the cylinder 12.

There is defined a circumferential groove 26 between the peripheral side portions 22*a* and 22*b* of the main body 22. Either water or a mixture of water and glycerin is introduced into the groove 26. Incidentally, sealing members 28 made of polyethylene resins, each having a cross-section U-shaped or V-shaped at a corresponding part of the main body 22 brought into contact with an inner peripheral wall 30 of a hollow cylindrical portion of the cylinder 12, are respectively held in sliding contact with the peripheral side portions 22*a*, 22*b* defining the groove 26 therebetween in such a way that the directions of openings defined in the respective sealing members 28 differ from each other, thereby making it possible to improve the degree of the peripheral side portions being hermetically sealed with the sealing members.

Figure 2A:
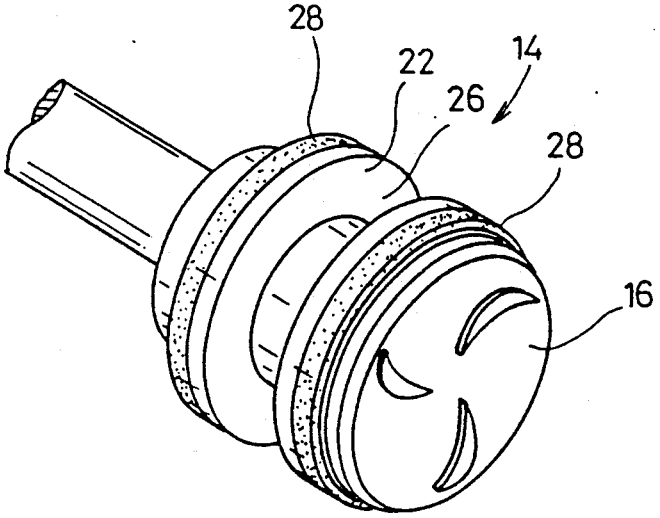
FIG. 2*a* is a perspective view of a piston of the intermediate reservoir.
Figure 2B:
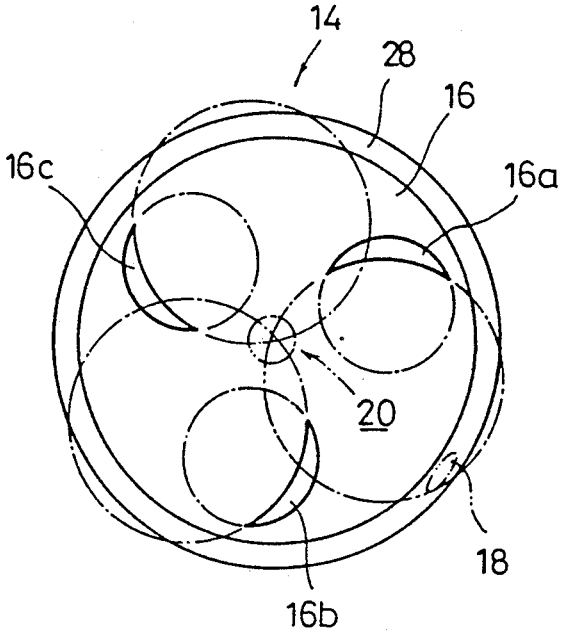
FIG. 2*b* is an end view of the piston of the intermediate reservoir.

A first cylinder chamber 34 is defined by the inner peripheral wall 30 of the hollow cylindrical portion of the cylinder 12 and the cylinder wall 32 of the cylinder 12, which faces the fluid-flow straightening member 16. The fluid-flow straightening member 16 is mounted on one of two end faces of the main body 22, which is opposite to the other thereof to which the piston rod 24 is fixed. As is easily understood from FIG. 2*a*, the fluid-flow straightening member 16 is provided with three crescent-shaped protrusions 16*a*, 16*b*, 16*c* each having an outer and an inner circular arc extending in the same direction. As shown in FIG. 2*b*, each of the protrusions 16*a*, 16*b*, 16*c* is disposed in a position where the intersection of three imaginary circles for describing the inner circular arcs coincides with the center line of the hole 20.

Incidentally, fluid-flow straightening members F (indicated by the two-dot chain line in FIG. 1) having protrusions different from the protrusions 16*a*, 16*b*, 16*c*, which are constructed in a manner similar to the protrusions 16*a*, 16*b*, 16*c*, may also be disposed on the cylinder wall 32 facing the fluid-flow straightening member 16.

The injection hole 18 and the discharge hole 20 are defined in the cylinder wall 32 which face one end face of the piston rod 24, on which the fluid-flow straightening member 16 is mounted. The discharge hole 20 communicates with the spray gun 38, and has the center line which positionally coincides with the point where the three imaginary circles respectively describing the inner circular arcs for defining the protrusions 16*a* through 16*c* intersect. On the other hand, the injection hole 18 for introducing paint and cleaning liquid into the first cylinder chamber 34 is defined in an outer peripheral edge of the cylinder wall 32 and extends to the outer peripheral wall of the cylinder 12 as shown in FIG. 1.

A second cylinder chamber 35 compartmented by the main body 22 is supplied with air serving as a drive source for reciprocatively sliding the piston 14 in the directions indicated by the arrows $X_1$ and $X_2$. In addition, the second cylinder chamber 35 has an air feed hole 19 defined therein, for discharging the so-supplied air to the outside.

In order to enable the intermediate reservoir 10 to be employed in a voltage block method as one of electrostatic spray painting methods, the intermediate reservoir 10 is caused to serve as an insulator as a whole. However, the intermediate reservoir 10 may be surrounded by an insulating material in such a manner as to have a function identical to that of the insulating material, i.e., an insulating function as needed.

A description will now be made of the entire structure of an electrostatic spray painting apparatus 33 according to the present embodiment, into which the intermediate reservoir 10 is inserted.

Figure 3:
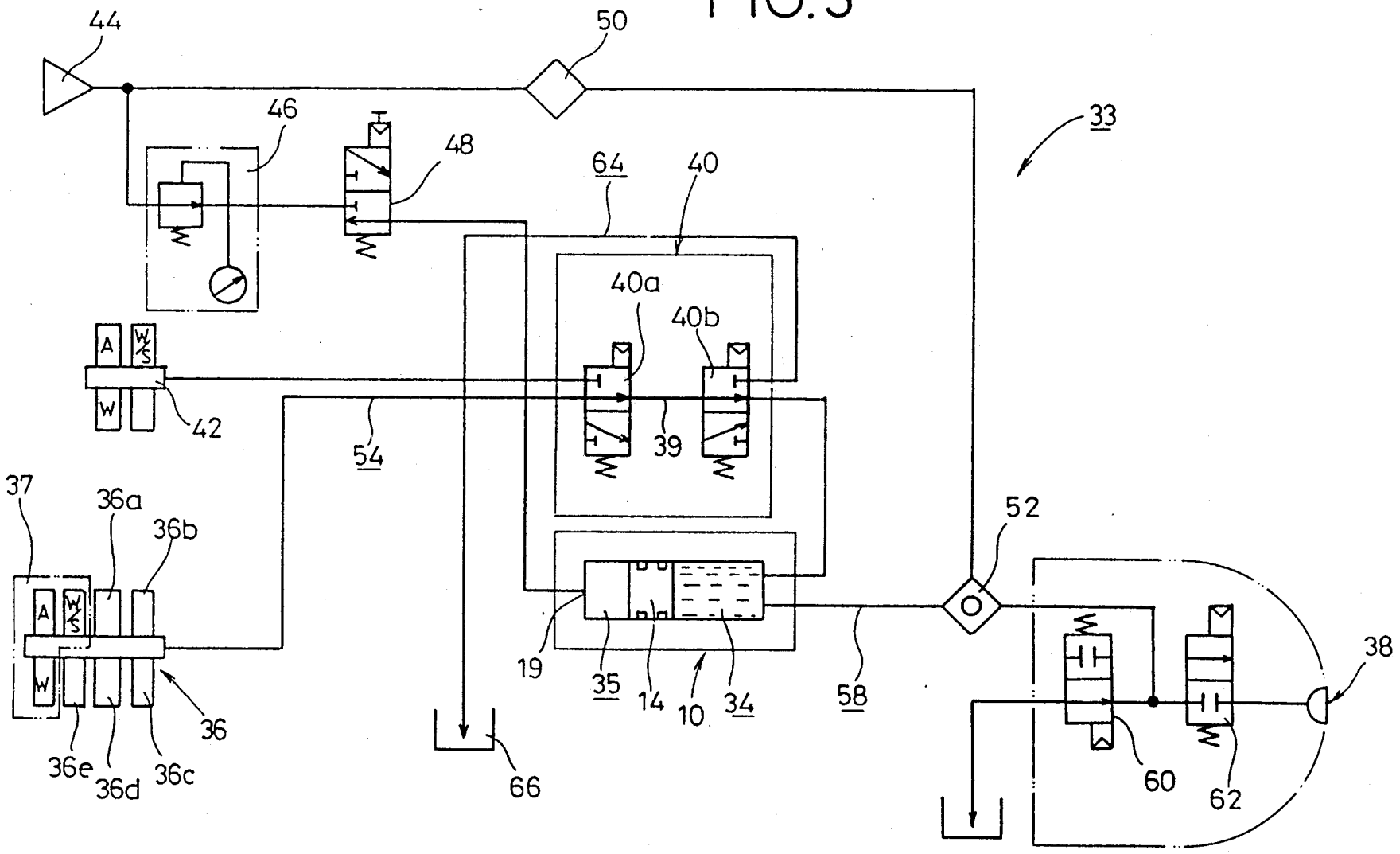
FIG. 3 is a diagram schematically showing the structure of the apparatus.

As shown in FIG. 3, the intermediate reservoir 10 is interposed between a color changeover valve mechanism 36 as a grounded paint feed source for selectively supplying a plurality of different paints and the spray gun 38 in the electrostatic spray painting apparatus 33.

Between the intermediate reservoir 10 and the color changeover valve mechanism 36, there is disposed a feed line 54 which has an electrically-insulated line 39 formed in at least one portion thereof and in which a block valve mechanism 40 including the line 39 is interposed.

The color changeover valve mechanism 36 comprises a first flush valve 37 for controlling the supply of air (A), water (W) and cleaning liquid (S) or the like, and a plurality of paint valves 36*a* through 36*e* thereof capable of supplying different paints.

The block valve mechanism 40 has changeover valves 40*a*, 40*b*. In addition, the block valve mechanism 40 is actuated to cause the changeover valve 40*a* on the inlet side to select either one of the color changeover valve mechanism 36 and a second flush valve 42 for controlling the supply of the air (A), the water (W) and the cleaning liquid (S) or the like, thereby connecting a selected one to the intermediate reservoir 10 via the feed line 54.

An air feed source 44 communicates with the second cylinder chamber 35 of the intermediate reservoir 10 through a flow control valve 46, an on-off valve 48 and the air feed hole 19, thereby actuating the piston 14.

On the other hand, the air feed source 44 is coupled via a booster 50 to a paint flow control device 52 for controlling the pressure of air. The flow control device 52 permits the control of the delivery rate of paint.

Between the intermediate reservoir 10 and the spray gun 38, there is provided a delivery line 58 with the flow control device 52 placed in an intervening position thereof. The spray gun 38 has a dump valve 60 and a trigger valve 62, and is coupled to an unillustrated high-voltage applying means.

The electrostatic spray painting apparatus 33 according to the first embodiment is basically constructed as described above. A description will now be made of the operation of the electrostatic spray painting apparatus 33.

When it is desired to carry out electrostatic spray painting, paint of a predetermined color is first pressure-fed from the paint valve 36*a* of the color changeover valve mechanism 36 as shown in FIG. 3. Then, the first cylinder chamber 34 of the intermediate reservoir 10 is charged with the paint through the feed line 54, and thereafter the spray gun 38 is also filled with the paint through delivery line 58. Upon charging of the spray gun 38 with the paint, the trigger valve 62 is closed and the dump valve 60 is opened. After completion of the charging of the spray gun 38 with the paint, the dump valve 60 is closed.

At this time, the changeover valves 40*a*, 40*b* of the block valve mechanism 40 are selectively operated to actuate the second flush valve 42 so as to clean the block valve mechanism 40, after which cleaning liquid used to clean the same is discharged into a waste-liquid tank 66 through a discharge line 64. Further, the block valve mechanism 40 is dried, thereby making it possible to electrically insulate the intermediate reservoir 10 from the color changeover valve mechanism 36.

Then, drive air is supplied from the air feed source 44 to the second cylinder chamber 35 of the intermediate reservoir 10 by way of the flow control valve 46 and the on-off valve 48 so as to displace the piston 14 toward the first cylinder chamber 34. As a consequence, the paint subjected to a high voltage is applied to an unillustrated work under the on-action of the trigger valve 62.

As an alternative to O rings, the sealing members 28 made of high-molecular weight resins, each having either the U-shaped cross section or the V-shaped cross section are respectively disposed between a peripheral edge of the piston end face defining the first cylinder chamber 34 and the inner peripheral wall 30 of the hollow cylindrical portion of the cylinder 12, and between a peripheral edge of another piston end face and the inner peripheral wall 30. Therefore, when the piston 14 is displaced toward the first cylinder chamber 34, either the U-shaped cross section or the V-shaped cross section of each of the sealing members 28 is opened in umbrella form under the pressure of either liquid or air within the first cylinder chamber 34, thereby making it possible to improve the degree of the peripheral edge of the piston 14 being hermetically sealed against the inner peripheral wall 30 of the hollow cylindrical portion of the cylinder 12 with the sealing members 28. As a result, the paint injected into the first cylinder chamber 34 can be prevented from slightly leaking.

Further, the peripheral edge of the piston 14 is released from being closely held against the inner peripheral wall 30 owing to some inconvenience such as dust applied to the inner peripheral wall 30 of the hollow cylindrical portion of the cylinder 12, distortion of the inner peripheral wall 30 itself. Thus, the paint injected into the first cylinder 34 may slightly leak. However, a slight leakage paint is allowed to diffuse into either water or a mixture of water and glycerin with which the circumferential groove 26 defined in the piston 14 is charged. As a result, the supply of the paint from the first cylinder chamber 34 to the spray gun 38 can be carried out without additionally providing a special step, and at the same time the residual adhesion of the leakage paint to the inner peripheral wall of the first cylinder chamber 34 can easily be avoided.

Figure 4:
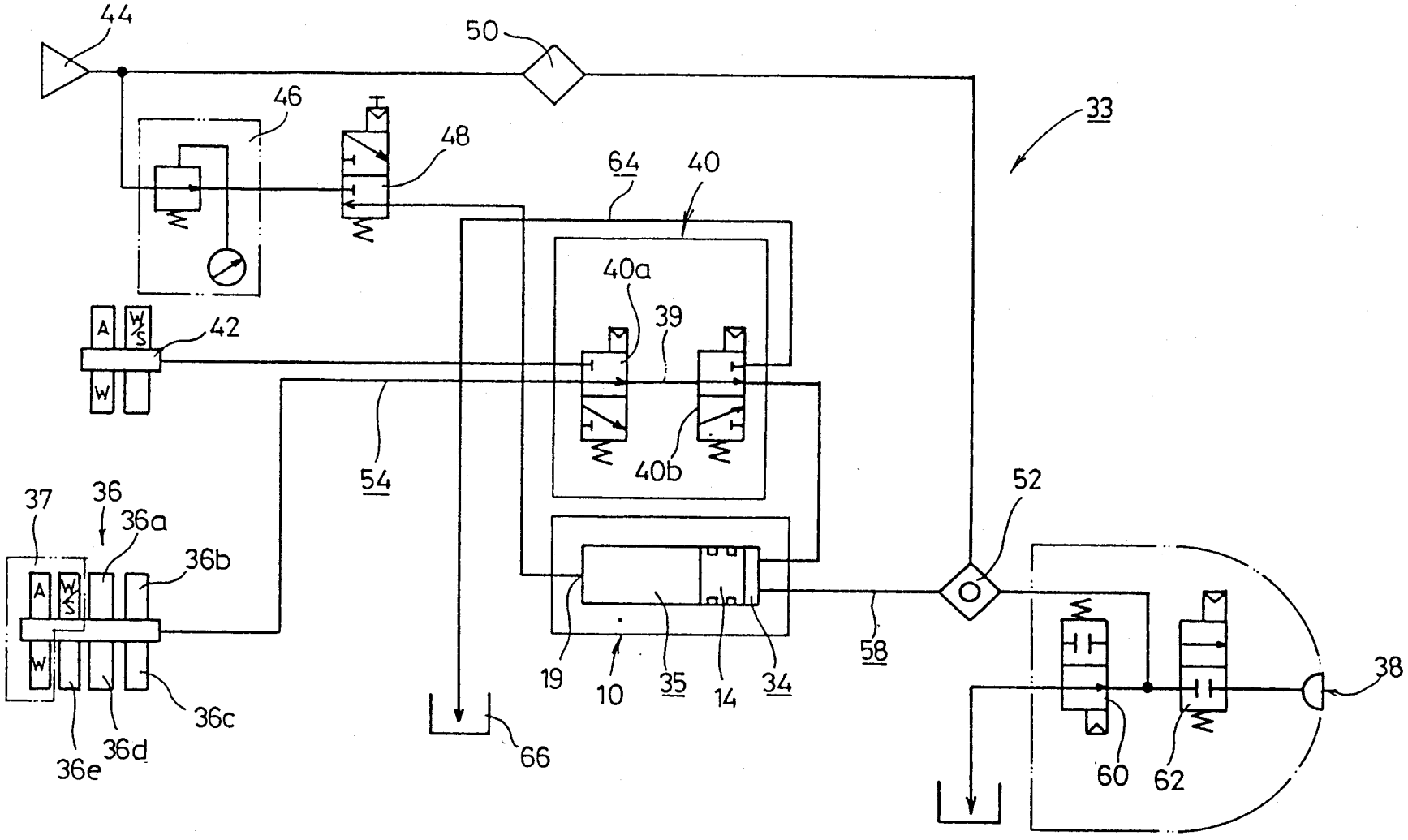
FIG. 4 is a diagram for describing the operation of the apparatus.

Then, the spray gun 38 is released from being subjected to the application of the high voltage thereto after completion of the above-described painting process. As shown in FIG. 4, the changeover valves 40*a*, 40*b* of the block valve mechanism 40 are thereafter selectively operated to actuate the first flush valve 37 so as inject the cleaning liquid into the first cylinder chamber 34 through the hole 18.

The cleaning liquid injected at this time makes a uniform vortex flow because each of the protrusions 16*a* through 16*c* of the fluid-flow straightening member 16 shown in FIGS. 1 and 2 is shaped in the crescent form. The paint used prior to the color changeover or replacement, which remains in the inner peripheral wall of the first cylinder chamber 34 and adheres thereto, can easily be removed from its inner peripheral wall owing to the generation of the uniform vortex flow, thereby making it possible to prevent paint applied to a workpiece after completion of the color changeover executed in the following step from mixing with the paint referred to above.

In addition, the cleaning liquid is pressure-fed through the hole 20 so as to clean the delivery line 58 and the spray gun 38.

After the above-described steps are completed, the circuit shown in FIG. 3 is used to select a desired color by using the paint valves 36*b* through 36*e* of the color changeover valve mechanism 36, after which the first cylinder chamber 34 and the spray gun 38 are filled with paint with its color and the block valve mechanism 40 is cleaned and dried. Thereafter, the painting process using the following color paint is carried out based on the same method as described above.

An electrostatic spray painting apparatus according to a second embodiment of the present invention will now be described below in detail with reference to the accompanying drawings.

Figure 5:
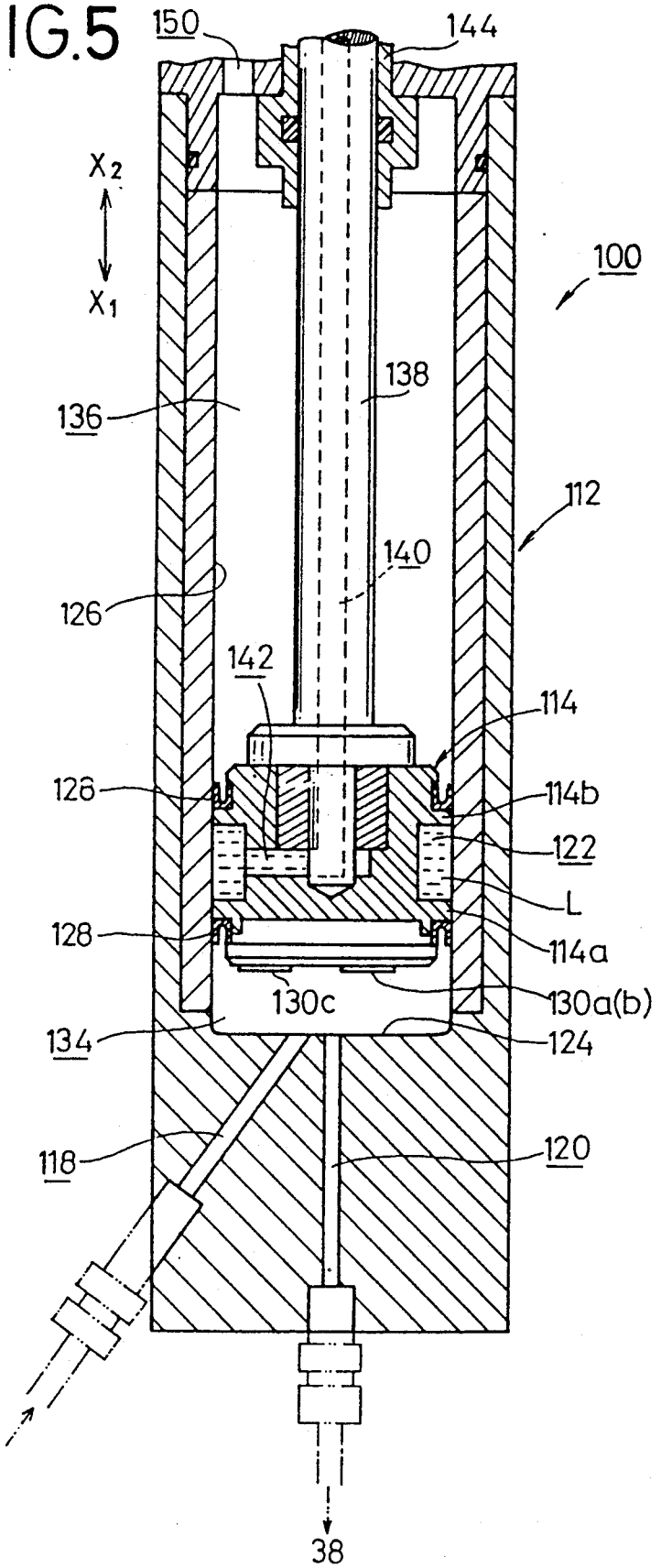
FIG. 5 is an enlarged cross-sectional view of an essential part of an intermediate reservoir of an electrostatic spray painting apparatus according to a second embodiment of the present invention.
Figure 6:
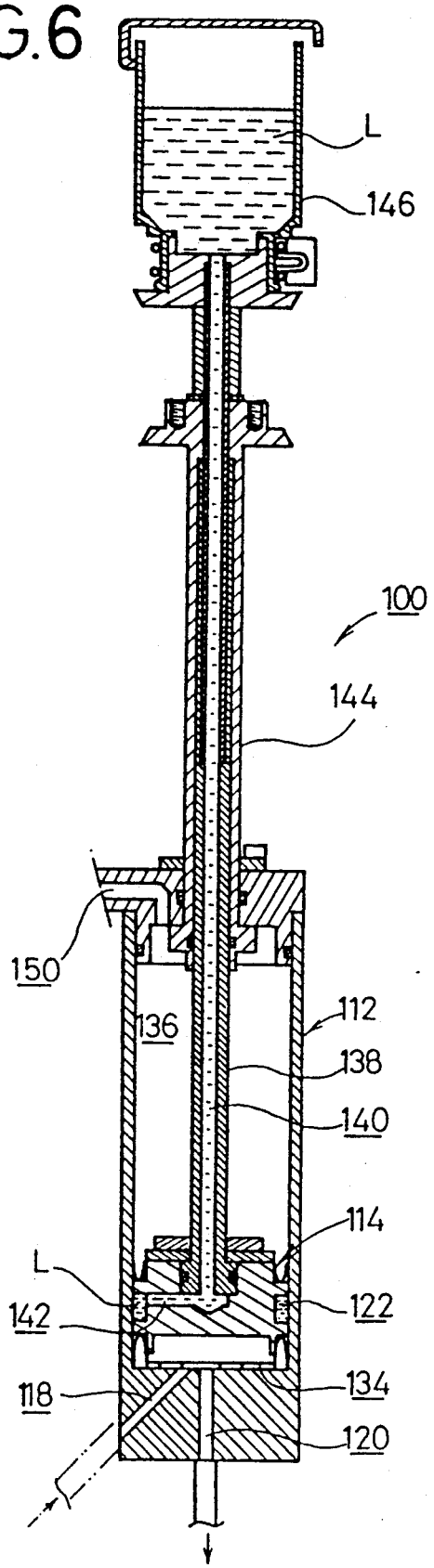
FIG. 6 is a vertical cross-sectional view showing the entire structure of the intermediate reservoir shown in FIG. 5.

Referring to FIGS. 5 and 6, designated at numeral 100 is an intermediate reservoir of the electrostatic spray painting apparatus according to the second embodiment. The intermediate reservoir 100 comprises a vertically-positioned cylinder 112, a piston 114, a hole 118 for the injection of paint and cleaning liquid, a hole 120 for the discharge of the paint and the cleaning liquid, and a cavity 122 created by defining a circumferential groove in a peripheral wall of the piston 114 and charged with cleaning fluid L comprising either water or a mixture of water and solvent such as glycerin.

Then, peripheral side portions 114*a*, 114*b* for defining the cavity 122 of the piston 114 are closely held against a cylinder wall 124. In addition, sealing members 128 made of polyethylene resins, each having a cross-section U-shaped or V-shaped in a corresponding part of the piston 114 brought into contact with an inner peripheral wall 126 of a hollow cylindrical portion of the cylinder 112, are respectively held in sliding contact with the peripheral side portions 114*a*, 114*b* in such a way that the directions of openings defined in the respective sealing members 128 are different from each other, thereby making it possible to improve the degree of the peripheral side portions 114*a*, 114*b* being hermetically sealed with the sealing members 128.

There are disposed, on one end surface of the piston 114, three crescent-shaped protrusions 130*a* through 130*c*. In addition, a first cylinder chamber 136 is defined on the side of the protrusions 130*a* through 130*c*. On the other hand, there is also disposed, within a second cylinder chamber 136 defined on the side opposite to the first cylinder chamber 134, a hollow piston rod 138 whose one end is secured to the piston 114. The piston rod 138 has a passage 140 centrally defined therein. One end of the passage 140 communicates with the cavity 122 through a hole 142 defined in the piston 114. The piston rod 138 extend through the cylinder 112 and extends upward in a state in which it is being inserted into a sleeve 144. In addition, a tank 146 for storing the cleaning fluid L therein is mounted on the other end of the piston rod 138. The tank 146 communicates with the cavity 122 through the passage 140 of the piston rod 138 and the hole 142 of the piston 114.

The holes 118 and 120 are defined in the cylinder wall 124 disposed below the cylinder 112. The hole 120 communicates with a spray gun 148, and the hole 118 for introducing the paint and the cleaning liquid into the first cylinder chamber 134 extends from an outer peripheral edge of the cylinder wall 124 to an outer peripheral wall of the cylinder 112. Incidentally, the paint and the cleaning liquid can more suitably be supplied by providing a plurality of injection holes 118. In addition, a process for discharging the paint and the cleaning liquid can be carried out smoother if the hole 120 is defined so as to be progressively opened toward the cylinder wall 124, i.e., it is tapered toward the side opposite to the cylinder wall 124.

There is defined in the second cylinder chamber 136, an air feed hole 150 for supplying air serving as a drive source for slidably moving the piston 114 in the direction indicated by the arrow $X_1$, to the second cylinder chamber 136 and for discharging the thus-suppled air to the outside. The sliding movement of the piston 114 in the direction indicated by the arrow $X_2$ is carried out by the pressure applied to the paint which is introduced into the first cylinder chamber 134.

Figure 7:
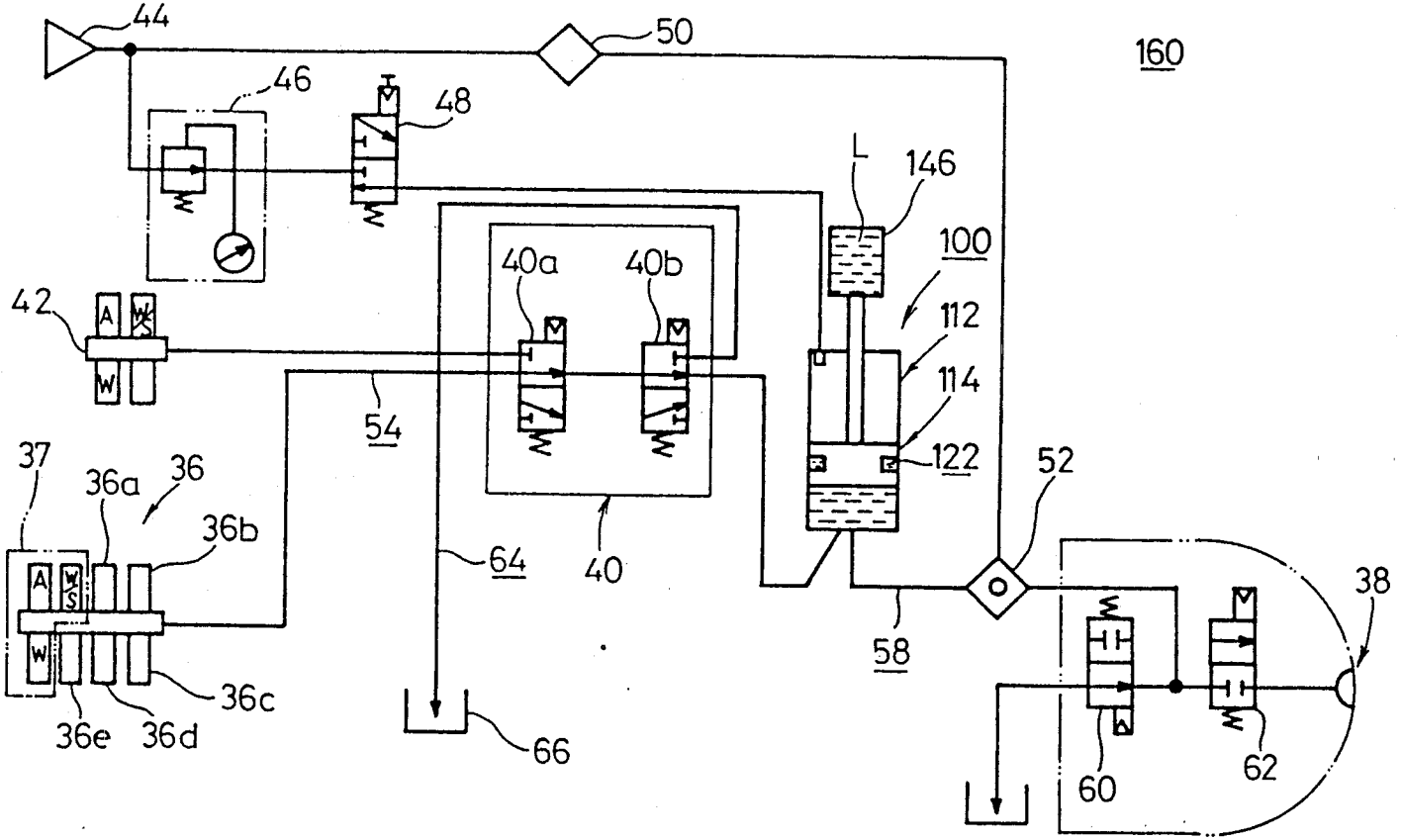
FIG. 7 is a diagram schematically showing the structure of the apparatus shown in FIG. 5.

Now, FIG. 7 shows the entire structure of an electrostatic spray painting apparatus 160 according to the second embodiment in which the intermediate reservoir 100 constructed as described above is interposed. Incidentally, the same elements of structure as those employed in the electrostatic spray painting apparatus according to the first embodiment are identified by like reference numerals and their detailed description will therefore be omitted.

The electrostatic spray painting apparatus 160 constructed as described above is operated in a manner similar to the electrostatic spray painting apparatus 33, and its description will therefore be omitted.

When pressurized air is supplied to the air feed hole 150 from the air feed source 44 to displace the piston 114 toward the first cylinder chamber 134, the introduction of the pressurized air into the cavity 122 from the sealing members 128 tends to easily occur. In addition, the cleaning fluid L, which has been stored in the cavity 122, leaks from the cavity 122 by repeatedly reciprocating the piston 114 within the cylinder 112, so that air is introduced into the cavity 122.

If the air still remains in the cavity 122 as described above, then the cleaning power with respect to the inner peripheral wall 126 of the hollow cylindrical portion of the cylinder 112 is reduced. When the cylinder 112 is horizontally disposed in particular, air remains in a position near an upper wall of the hollow cylindrical portion of the cylinder 112, thereby causing a problem that such a region cannot be cleaned. As a result, the paint is dried in the position near the upper wall referred to above, thereby causing damage to the sealing members 128 and the inner peripheral wall 126 of the cylinder 112.

However, in the present embodiment, the cleaning fluid L can reliably be brought into contact with the entire region of the inner peripheral wall 126 by placing the cylinder 112 in a vertical position even when air exists in the cavity 122, thereby enabling an improvement in the cleaning of the inner peripheral wall 126. In the present embodiment as well, the cavity 122 of the piston 114 is caused to communicate with the tank 146 through the hole 142 and the passage 140 of the piston rod 138. It is therefore possible to automatically supply the cleaning fluid L in the tank 146 to the cavity 122. At this time, the life of each sealing member 128 and the timing for replacing the cleaning fluid L with another or improper or undesired conditions which occur in the piston 114, the cylinder 112, etc. can be detected according to the condition of the paint being dissolved in the tank 146.

Further, air can be discharged into the outside from the tank 146 through the hole 142 and the passage 40 even when the air is introduced into the cavity 122 because the cavity 122 communicates with the tank 146. It is therefore possible to avoid a reduction in the detergency and prevent the paint introduced into the cavity 122 from being dried, thereby making it possible to efficiently and reliably carry out the cleaning work.

Furthermore, the inner peripheral wall 126 of the cylinder 112 is always cleaned by the cleaning fluid L with which the cavity 122 of the piston 114 is charged. It is therefore unnecessary to withdraw the piston 114 in the direction indicated by the arrow $X_2$ at the time of the cleaning work. As a consequence, the cleaning work can be performed in a short period of time and the cleaning liquid can efficiently be used.

An electrostatic spray painting apparatus according to a third embodiment of the present invention will now be described below with reference to the accompanying drawings.

Figure 8:
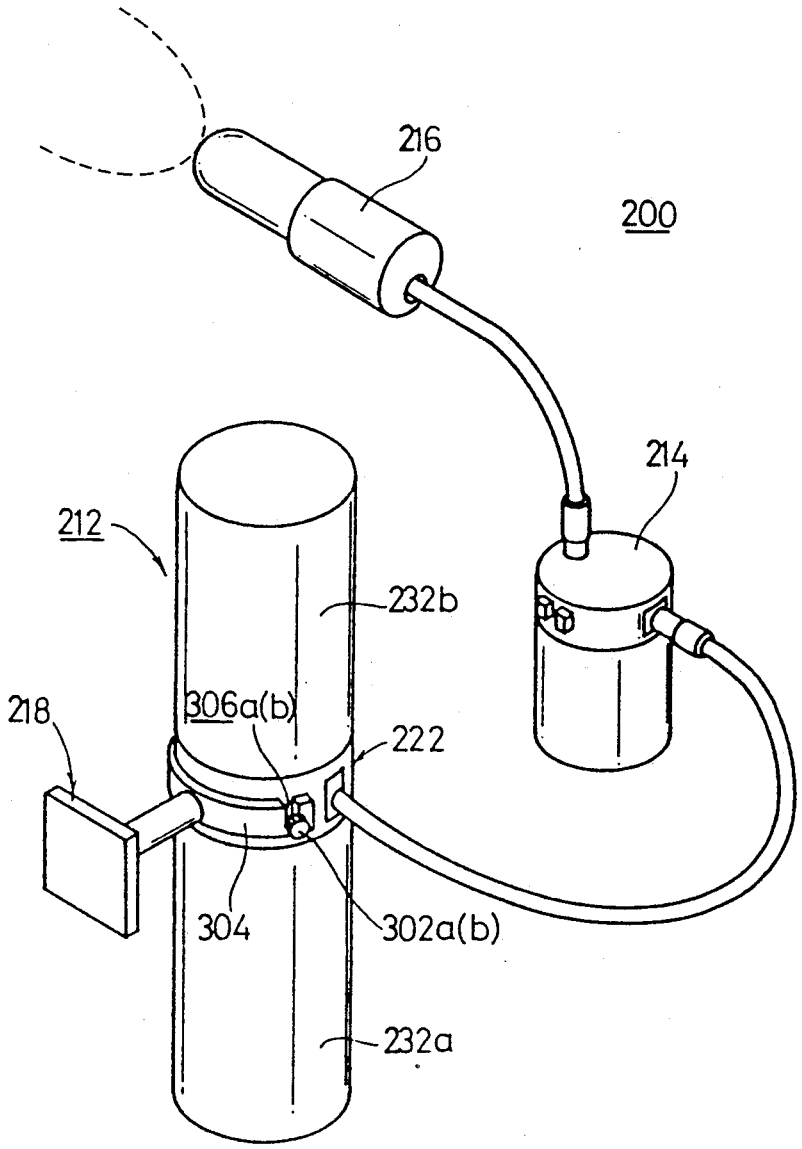
FIG. 8 is a fragmentary perspective view of an electrostatic spray painting apparatus according to a third embodiment of the present invention.

Referring to FIG. 8, designated at numeral 200 is the electrostatic spray painting apparatus according to the third embodiment. The electrostatic spray painting apparatus 200 has an intermediate reservoir 212 which is coupled to an unillustrated color changeover valve mechanism or the like and to which a spray gun 216 is coupled through a four-way changeover valve 214. In addition, the intermediate reservoir 212 is fixed in an upright state by the holding device 218.

Figure 9:
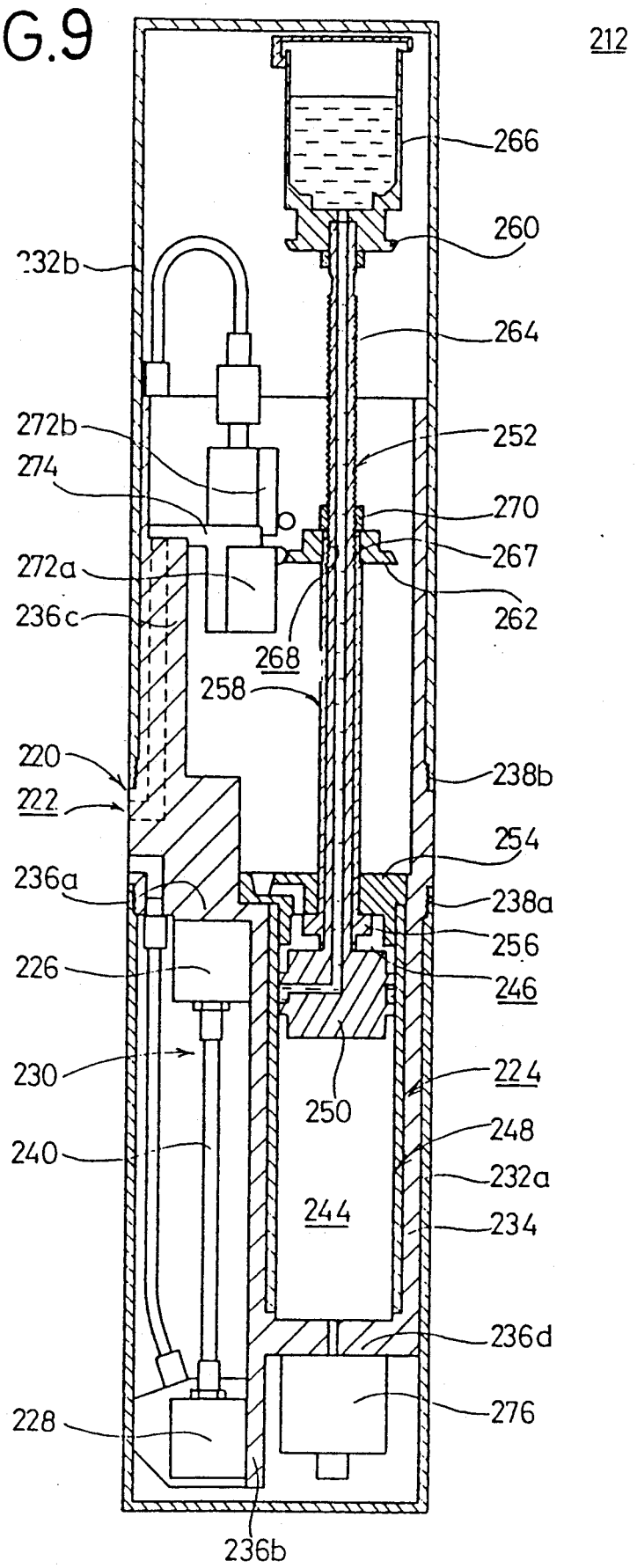
FIG. 9 is a vertical cross-sectional view of an intermediate reservoir of the apparatus shown in FIG. 8.

As shown in FIG. 9, the intermediate reservoir 212 comprises a manifold base 222 which has a line connecting portion 220 capable of being externally equipped with a plurality of lines and which is made of an electrical insulating material, a reservoir 224 provided integrally with the manifold base 222 and used to temporarily store conductive coating or paint therein, an insulation mechanism 230 having a pair of three-way changeover valves 226, 228 spaced a predetermined distance from each other and disposed along the reservoir 224, and covers 232*a*, 232*b* made of an electrical insulating material, which cover devices including the insulation mechanism 230 or the like and are mounted on the manifold base 222.

The manifold base 222 has an outer wall 234 of the reservoir 224 and device attachments 236*a* through 236*d* all of which being formed integrally with one another, as well as the line connecting portion 220 to be described later. In addition, the manifold base 222 also has screws 238*a*, 238*b* formed in the opposite ends of the line connecting portion 220, for fastening the covers 232*a*, 232*b*. The three-way changeover valves 226, 228 of the insulation mechanism 230 are secured to the device attachments 236*a*, 236*b*. Between the three-way changeover valves 226 and 228, there is also disposed an insulated line 240 having a predetermined length, which can be insulated from a given high voltage.

The reservoir 224 comprises a storage chamber 248 supplied with paint from a first cylinder chamber (one end side) 244 and supplied with air from a second cylinder chamber (other end side) 246, a piston 250 movably disposed in the storage chamber 248, a rod 252 which extend from an end of the piston 250 to an air feed side and projects outwardly of the storage chamber 248, a hollow rod 258 which is mounted on the outer periphery of the rod 252 in such a manner as to be axially movable relative to the rod 252 and which is provided with an extension 256 disposed between the cover 254 forming the storage chamber 248 and the piston 250 so as to be held in engagement with the cover 254, and detecting dog (detecting means) 260, 262 mounted on the rod 252 and the hollow rod 258 respectively, for detecting respective positions where the piston 250 is reciprocatively moved.

The rod 252 has a screw 264 formed on the outer peripheral wall thereof. In addition, there is mounted, on the upper part of the rod 252, a tank 266 for storing cleaning fluid therein. The tank 266 has the detecting dog 260 formed in position therebelow. The hollow rod 258 externally mounted on the rod 252 is provided with the detecting dog 262 externally mounted on an upper-end small-diameter portion 267 which projects outward from the storage chamber 248. In addition, the hollow rod 258 has a screw channel 268 which is defined in the inner peripheral wall of the small-diameter portion 267 and threadedly engages the screw 264. The rod 252 and the hollow rod 258 are fixed to each other by a nut 270 which threadedly engages the screw 264 so as to press against an end face of the detecting dog 262 and support the same thereon.

On-off valves 272*b*, 272*a* respectively held in engagement with the detecting dogs 260, 262 so as to be actuated selectively, are secured to the device attachment 236*c* of the manifold base 222 by a mounting member 274. A flow control valve 276 which communicates with the first cylinder chamber 244 of the reservoir 224 and is used to control the delivery rate of paint, is fixed to the device attachment 236*d* of the manifold base 222.

Figure 10:
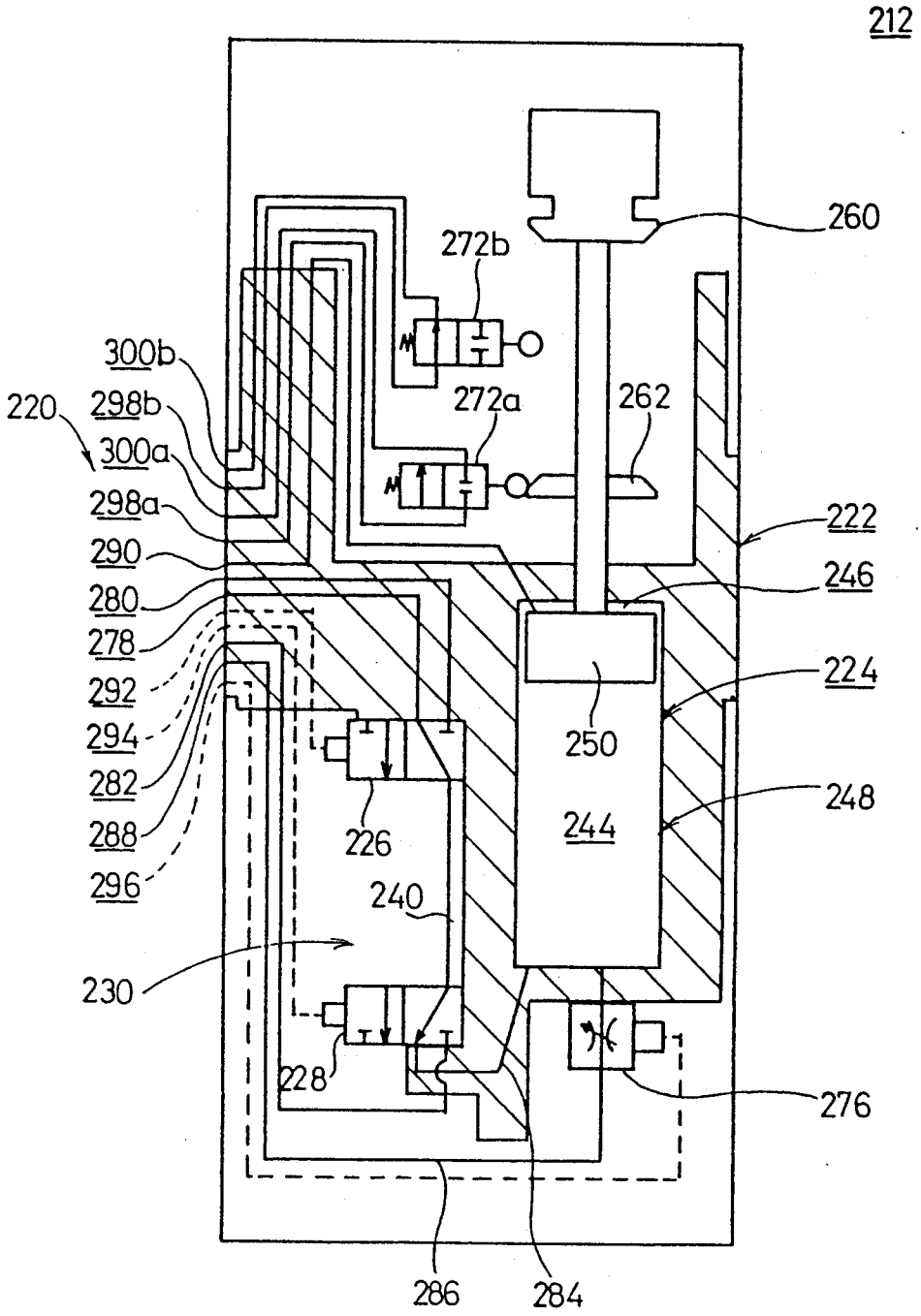
FIG. 10 is a diagram for describing a flow-channel system of the intermediate reservoir illustrated in FIG. 9.

A description will hereinafter be made of a flow-channel system of the intermediate reservoir 212 with reference to FIG. 10.

The line connecting portion 220 formed in the end of the manifold base 222 has a paint inlet 278 and a cleaning liquid inlet 280 provided adjacent to each other. The paint inlet 278 and the cleaning liquid inlet 280 communicate with respectively corresponding ports of the three-way changeover valve 226. The three-way changeover valve 228, which communicates via the insulated line 240 with the three-way changeover valve 226, is actuated to cause a cleaning liquid outlet 282 opened at the line connecting portion 220 and a paint flow channel 284 open with respect to the first cylinder chamber 244 of the reservoir 224 to selectively communicate. In addition, a paint flow channel 286 communicates via the flow control valve 276 with the first cylinder chamber 244 and with a paint outlet 288 opened at the line connecting portion 220.

The line connecting portion 220 has a first drive air port 290 defined therein, which is used to displace the piston 250 toward the first cylinder chamber 244, and second to fourth drive air ports 292 through 296 defined therein, which are used to actuate the three-way changeover valves 226, 228 and the flow control valve 276. In addition, the line connecting portion 220 also has air inlets 298*a*, 298*b* defined therein, which are used to introduce air for detection into the on-off valves 272*a*, 272*b* and discharge the same therefrom, and air outlets 300*a*, 300*b* defined therein.

The holding device 218 has bolts 302*a*, 302*b* mounted on the outer wall of the intermediate reservoir 212, a frame 304 having the shape corresponding to the outer shape of the intermediate reservoir 212, and grooves 306*a*, 306*b* defined in the frame 304 and used to fit the bolts 302*a*, 302*b* therein so as to hold the intermediate reservoir 212 in the upright position. The frame 304 is fixed to a side wall (not shown) in a job site.

The operation of the electrostatic spray painting apparatus 200 constructed as described above will now be described below.

First of all, the paint inlet 278 is coupled to the unillustrated color changeover valve mechanism, and the cleaning liquid inlet 280 is coupled to a flush valve. In addition, the cleaning liquid outlet 282 is connected to a waste-liquid tank. The paint outlet 288 communicates with the spray gun 216 through the four-way changeover valve 214, and the first to fourth drive air ports 290 through 296 are coupled to an air feed source. Further, the air inlet 298*a* and the air outlet 300*a*, and the air inlet 298*b* and the air outlet 300*b* are coupled to detecting units respectively.

When paint of a predetermined color is pressure-fed to the paint inlet 278 from the color changeover valve mechanism upon execution of the electrostatic spray painting process by the electrostatic spray painting apparatus 200, the paint is supplied via the insulated line 240 to the three-way changeover valve 228 from the three-way changeover valve 226. Thereafter, the paint is introduced into the first cylinder chamber 244 of the reservoir 224 through the paint flow channel 284. The paint with which the first cylinder chamber 244 has been charged is delivered from the paint flow channel 286 to the four-way changeover valve 214 via the paint outlet 288, after which the spray gun 216 is charged with the paint. At this time, the piston 250 and the hollow rod 258 are integrally moved upward as the first cylinder chamber 244 is charged with the paint. As a consequence, the dog 262 mounted on the small-diameter portion 267 of the hollow rod 258 is held in engagement with the on-off valve 272*a*, thereby making it possible to automatically detect that the storage chamber 248 has been charged with a predetermined quantity of paint. Further, the extension 256 attached to the lower end of the hollow rod 258 is held in engagement with the cover 254 so as to prevent the piston 250 from being moved upward, thereby making it possible to accurately charge the storage chamber 248 with a desired amount of paint.

Then, drive air is supplied to the second and third drive air ports 292, 294 from the air feed source, so that the changeover operations of the three-way changeover valves 226, 228 of the insulation mechanism 230 are made. Therefore, the cleaning liquid supplied from the flush valve successively passes through the cleaning liquid inlet 280, the three-way changeover valve 226, the insulated line 240 and the three-way changeover valve 228, and is then discharged into the waste-liquid tank through the cleaning liquid outlet 282. Thus, the insulation mechanism 230 is dried, and hence the color changeover valve mechanism and the intermediate reservoir 212 are electrically insulated from each other.

The drive air is supplied to the first drive air port 290 from the air feed source so as to displace the piston 250 toward the first cylinder chamber 244. The delivery rate of the paint is controlled by the flow control valve 276, and thereafter desired paint is supplied to an unillustrated work from the spray gun 216 in a state in which a high voltage is applied directly to the paint. At this time, the piston 250 is displaced toward the first cylinder chamber 244, so that the dog 260 is held in engagement with the on-off valve 272*b*, thereby automatically detecting information about the displacement of the piston 250 toward the first cylinder chamber 244.

In the present embodiment, when it is desired to apply paint to different types of workpieces, for example, the quantity of the paint to be supplied to the spray gun 216 can easily be changed. More specifically, after the cover 232*b* is removed from the manifold base 222, the rod 252 is rotated in a predetermined direction in a state in which the nut 270 for fixing the rod 252 and the hollow rod 258 to each other is being rotated in a releasing direction. Thus, the rod 252 and the hollow rod 258 are axially moved relative to each other. After the rod 252 and the hollow rod 258 are placed in position, the nut 270 is tightened so as to fixedly secure the rod 252 and the hollow rod 258 to each other.

Figure 11:
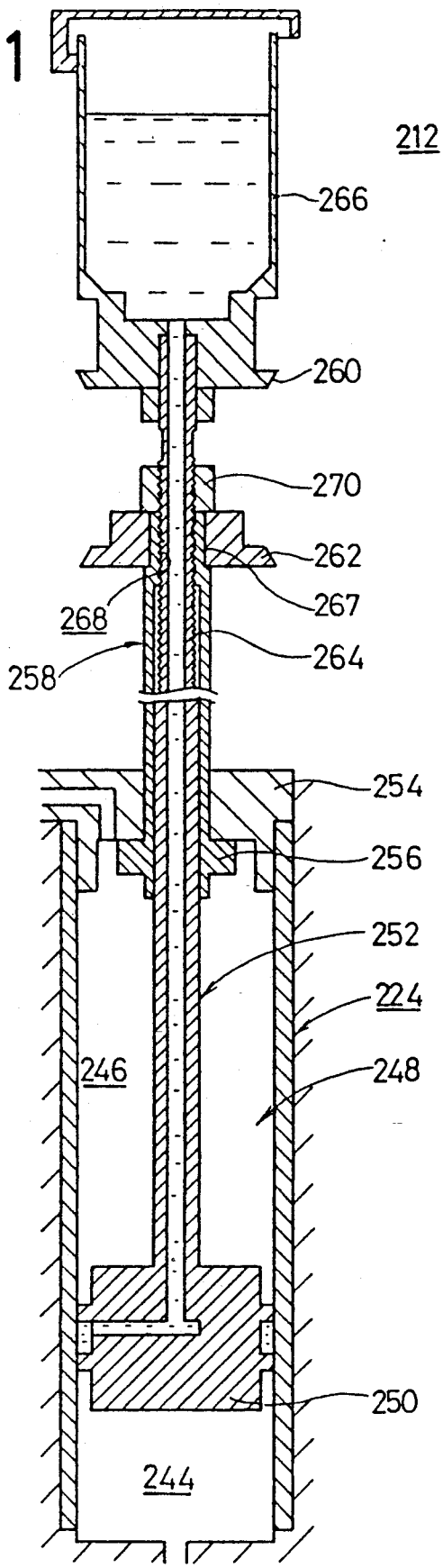
FIG. 11 is a diagram for describing an air/paint adjusting process carried out in a storage portion of the intermediate reservoir of FIG. 9.

The position where the dog 262 mounted on the hollow rod 258 is held in engagement with the on-off valve 272*a* corresponds to a withdrawal position of the piston 250. The rod 252 is rotated to displace the withdrawal position of the piston 250 in the storage chamber 248. When the piston 250 is displaced toward the first cylinder chamber 244 as shown in FIG. 11 by way of example, the dog 260 of the rod 252 is moved toward the on-off valve 272*b*, thereby shortening a distance of an reciprocating motion of the piston 250. Therefore, the quantity of the paint stored in the storage chamber 248 is reduced, thereby reducing the quantity of the paint supplied to the spray gun 216. In this case, the piston 250 is no longer moved beyond a predetermined withdrawal position (upwardly-elevated position) by holding the extension 256 attached to the hollow rod 258 in engagement with the cover 254, thereby making it possible to reliably and accurately charge the storage chamber 248 with a desired quantity of paint.

As described above, the present embodiment can bring about an advantageous effect in that the quantity of the paint stored in the storage chamber 248 can be changed easily and accurately by simply rotating the rod 252 and the hollow rod 258 relative to each other so as to displace the withdrawal position of the piston 250. Thus, a desired quantity of paint can be supplied to the spray gun 216 according to the shape and the dimensions of a work, thereby making it possible to efficiently carry out a process for applying paint to different types of works.

In addition, the electrostatic spray painting apparatus according to the present invention can bring about advantageous effects as compared with a conventional apparatus provided with a paint measuring means and a paint feed confirmation means in that it can structurally be simplified at a time and the intermediate reservoir 212 can easily be rendered small as a whole, thereby enabling the intermediate reservoir 212 to be economically manufactured.

An electrostatic spray painting apparatus according to a fourth embodiment of the present invention will further be described below with reference to the accompanying drawings.

Figure 12:
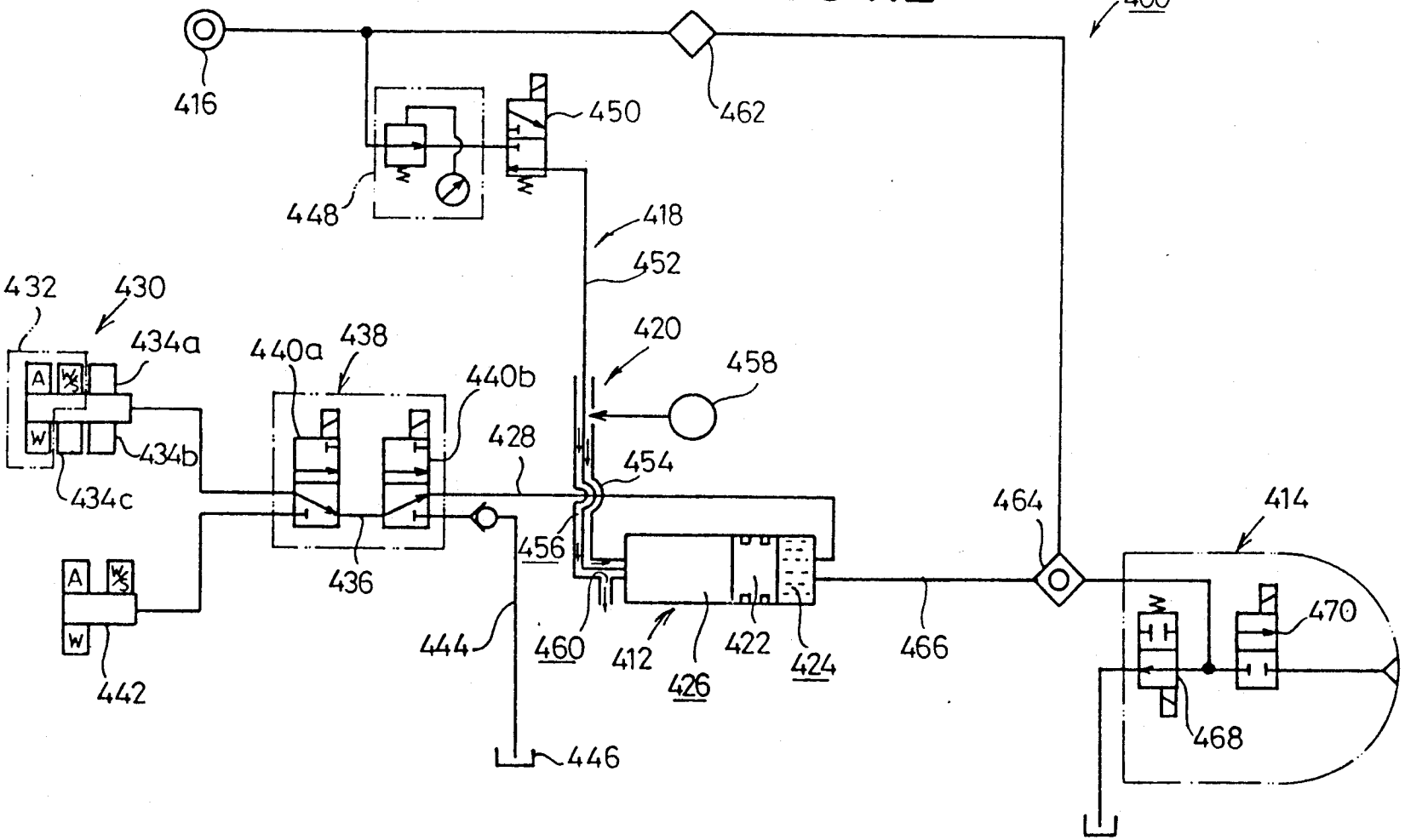
FIG. 12 is a diagram schematically showing the structure of an electrostatic spray painting apparatus according to a fourth embodiment of the present invention.

Referring to FIG. 12, designated at numeral 400 is the electrostatic spray painting apparatus according to the fourth embodiment. The electrostatic spray painting apparatus 400 comprises an electrically-insulated intermediate reservoir 412 for storing therein conductive coating or paint to which a high voltage is applied, an air feed source (pressurized-air feed mechanism) 416 for supplying pressurized air to the intermediate reservoir 412 so as to deliver the conductive paint stored in the intermediate reservoir 412 to a spray gun 414, a vent mechanism 418 for discharging the pressurized air to the outside from the intermediate reservoir 412 after completion of the supply of the conductive paint to the spray gun 414, and a dew-condensation prevention mechanism 420 for preventing the vent mechanism 418 from being subjected to the dew condensation.

The intermediate reservoir 412 is formed of an electrical insulating material, and has a first cylinder chamber 424 compartmentalized by a piston 422 and used for the injection of conductive paint and cleaning liquid, and a second cylinder chamber 426 used for the supply of air. A grounded color changeover valve mechanism 430 is coupled via a feed line 428 to the first cylinder chamber 424. The color changeover valve mechanism 430 comprises a first flush valve 432 for controlling the supply of air (A), water (W) and cleaning liquid (S) or the like, and a plurality of paint valves 434*a* through 434*c* capable of supplying conductive paint of different colors.

There is interposed, in the feed line 428, a block valve mechanism 438 including an electrically-insulated line 436 made of a resin such as polytetrafluoroethylene (PTFE), which is formed in at least one portion thereof. The block valve mechanism 438 has changeover valves 440*a*, 440*b*. In addition, the block valve mechanism 438 is actuated to cause the changeover valve 440*a* on the inlet side to select either one of the color changeover valve mechanism 430 and a second flush valve 442 for controlling the supply of the air (A), the water (W) and the cleaning liquid (S) or the like. The changeover valve 440*b* is coupled to a waste-liquid tank 446 through a discharge line 444.

The air feed source 416 communicates with the second cylinder chamber 426 through a flow control valve 448, and an on-off valve 450 and a line 452 of the vent mechanism 418. A line 454 of the dew-condensation prevention mechanism 420 is disposed as a double line in such a manner that a passage 456 is defined between the line 454 and the line 452. The line 454 has one end to which an air feed source 458 for supplying dry air is coupled, and the other end in which a discharge port for discharging the dry air to the outside is defined.

The air feed source 416 is coupled via a booster 462 to a conductive-paint flow control device 464 for controlling air pressure. The delivery rate of conductive paint is controlled by the flow control device 464.

A spray gun 414 is coupled to the first cylinder chamber 424 of the intermediate reservoir 412 through a delivery line 466. The spray gun 414 includes a dump valve 468 and a trigger valve 470 and is electrically connected to an unillustrated high-voltage applying means.

The operation of the electrostatic spray painting apparatus 400 constructed as described above will now be described below.

The first cylinder chamber 424 of the intermediate reservoir 412 is first charged via the feed line 428 with conductive paint of a predetermined color, which is pressure-fed from the paint valve 434*a* of the color changeover valve mechanism 430, and thereafter the spray gun 414 is fully filled with the conductive paint by way of the delivery line 466. Upon charging of the spray gun 414 with the conductive paint, the trigger valve 470 is closed, whereas the dump valve 468 is opened. After completion of the charging of the spray gun 414 with the conductive paint, the dump valve 468 is closed.

Then, the changeover operations of the changeover valves 440*a*, 440*b* of the block valve mechanism 438 are carried out to actuate the second flush valve 442 so as to clean the block valve mechanism 438, after which cleaning liquid and water used to clean the same are discharged into the waste-liquid tank 446 through the discharge line 444. Thereafter, the block valve mechanism 438 is dried, thereby electrically insulating the color changeover valve mechanism 430 and the intermediate reservoir 412 from each other.

Then, driving pressurized air is supplied via the flow control valve 448 and the on-off valve 450 to the second cylinder chamber 426 of the intermediate reservoir 412 from the air feed source 416 so as to displace the piston 422 toward the first cylinder chamber 424. As a consequence, the conductive paint is applied to an unillustrated workpiece under the on-action of the trigger valve 470 in a state in which a high voltage is applied to the conductive paint.

When the on-off valve 450 of the vent mechanism 418 is actuated to open the line 452 in such a manner as to be in contact with the atmosphere after the supplying process of the conductive paint is completed, the pressurized air in the second cylinder chamber 426 of the intermediate reservoir 412 is discharged from the line 452 to the outside by the on-off valve 450. At this time, the pressurized air is adiabatically-expanded so as to cool the line 452. Thus, there is the possibility of the dew condensation appearing on an outer peripheral surface of the line 452.

In the fourth embodiment, the line 454 of the dew-condensation prevention mechanism 420 is disposed in such a manner as to cover the line 452. In addition, the dry air is supplied to the passage 456 defined between the line 454 and the line 452 from the air feed source 458. Then, the dry air passes through the passage 456 so as to dry the outer peripheral surface of the line 452, followed by discharge of the dry air to the outside from the discharge port 460. It is therefore possible to prevent moisture or water in the atmosphere from being condensed onto the outer peripheral surface of the line 452 and applied thereto. As a consequence, an undesired flow of electricity can reliably be prevented upon application of the high voltage to the conductive paint, thereby making it possible to efficiently and easily achieve the entire painting process.

Incidentally, there are provided, as the dew-condensation prevention mechanism 420, the line 454 for covering the line 452, and the air feed source 458 for supplying the dry air between the lines 454 and 452 in the fourth embodiment. However, the present invention is not necessarily limited to the fourth embodiment. It is needless to say that various arrangements can be adopted. More specifically, the outer peripheral surface of the line 452 can be prevented from being subjected to the dew condensation by supplying air heated up to a predetermined temperature to the passage 456 defined between the lines 454 and 452. In addition, the dew-condensation prevention mechanism may be constructed by either the line 454 or the line 452 of the vent mechanism 418,.which is made of a heat insulating material. Furthermore, a heating mechanism for heating the outer peripheral surface of the line 452 may also be disposed as the dew-condensation prevention mechanism.

According to one feature of the electrostatic spray painting apparatus of the present invention, as has been described above, a plurality of fluid-flow straightening members are disposed within a paint-filling cylinder chamber defined by a cylinder and a piston. Therefore, cleaning liquid injected from an injection hole after completion of the discharge of paint used prior to the color replacement makes a vortex flow anew, thereby making it possible to easily remove such paint which remains in an inner peripheral wall of the cylinder chamber and adheres thereto. Therefore, the paint used prior to the color replacement and the paint subsequent to the color replacement can be prevented from mixing with each other. Thus, new paint of an unadulterated color can be applied to a workpiece.

In addition, sealing members made of high-molecular weight resins, each having either a U-shaped cross section or a V-shaped cross section are interposed between a peripheral edge of a piston end face defining a cylinder chamber and a cylinder wall. Therefore, the degree of the peripheral edge of the piston being hermetically sealed against the cylinder wall with the sealing members can be improved. Further, the paint injected into the cylinder chamber can be prevented from slightly leaking.

According to another feature of the present invention, cleaning fluid is introduced into a cavity defined in a peripheral wall of the piston which is reciprocatively and slidably disposed within the cylinder. Therefore, the inner peripheral wall of the cylinder is cleaned at all times when the piston is reciprocatively slid. Thus, even when the peripheral edge of the piston is released from being hermetically sealed against the cylinder wall, and the paint injected into the cylinder slightly leaks, the leakage paint, which remains in the inner peripheral wall of the cylinder chamber and adheres thereto, can easily be removed without additionally providing a special processing step by diffusing the slight leakage paint into the cleaning fluid which has been stored in the cavity defined in the piston. In addition, the paint cleaning work prior to the color replacement can efficiently be carried out.

In addition to the feature referred to above, air in the cavity can reliably be eliminated and the detergent action can be improved by vertically disposing the cylinder and causing a tank to communicate with the cavity.

According to a further feature of the present invention, a movable distance of the piston can be increased and reduced by displacing axial positions of a rod and a hollow rod movable relative to each other, thereby making it possible to change the quantity of paint stored in a storage chamber according to a desired portion to which paint is to be applied. In addition, the quantity of paint supplied to a spray gun can reliably and easily be changed with an extremely simple structure according to the portion to be applied, thereby making it possible to carry out an efficient painting process with respect to various portions to which paint is to be applied.

According to a still further feature of the present invention, when pressurized air is discharged to the outside by a vent mechanism after conductive paint in an intermediate reservoir is supplied to the spray gun under the action of a pressurized-air feed mechanism, a dew-condensation prevention mechanism is activated to make it possible to reliably prevent the vent mechanism from being subjected to the dew condensation. Therefore, when a high voltage is applied to the conductive paint, any undesired flow of electricity is not developed, thereby making it possible to carry out an efficient painting process.

Having now fully described the invention, it will be apparent to those skilled in the art that many changes and modifications can be made without departing from the spirit or scope of the invention as set forth herein.

What is claimed is:

1. An electrostatic spray painting apparatus comprising:

an electrically-insulated intermediate reservoir for storing therein conductive paint to which a high voltage is applied, said intermediate reservoir including:

a cylinder;

a piston reciprocatively and slidably disposed within said cylinder;

a fluid-flow straightening member protruding into one part of a cylinder chamber to be charged with the paint, said cylinder chamber being defined by said cylinder and said piston;

an injection hole defined proximate an outer peripheral edge of a wall of said cylinder so as to be connected to a paint and cleaning liquid feed source; and a discharge hole centrally defined in said wall so as to be connected to a spray gun, said discharge hole being used to discharge the paint and the cleaning liquid;

wherein said fluid-flow straightening member comprises a plurality of crescent-shaped protrusions each having an outer and an inner circular arc extending in a same direction such that fluid injected from said injection hole forms a vortex flow.

2. An electrostatic spray painting apparatus according to claim 1, wherein said fluid-flow straightening member is mounted on an end face of said piston, said end face constituting an inner wall of the cylinder chamber.

3. An electrostatic spray painting apparatus according to claim 1, wherein said fluid-flow straightening member is mounted on an inner wall of the cylinder chamber facing an end face of said piston.

4. An electrostatic spray painting apparatus according to claim 1, and further including a cavity defined by a circumferential groove in a peripheral wall of said piston, said cavity being charged with either water or a mixture of water and glycerin.

5. An electrostatic spray painting apparatus according to claim 1, and further including sealing members made of high-molecular weight resins mounted on a peripheral wall of said piston, said sealing members each having either a U-shaped cross section or a V-shaped cross section.

6. An electrostatic spray painting apparatus according to claim 4, wherein said cylinder is vertically disposed in such a manner that said injection hole and said discharge hole extend in a downward direction.

7. An electrostatic spray painting apparatus according to claim 6, and further including a hollow piston rod, wherein one end of said hollow piston rod is fixedly secured to said piston, and another end of said hollow piston rod includes a tank for storing the cleaning fluid therein, and said cavity of said piston and said tank communicate with each other through said hollow piston rod.

8. An electrostatic spray painting apparatus comprising:

an electrically-insulated intermediate reservoir for storing therein conductive paint to which a high voltage is directly applied, said intermediate reservoir including:

a storage chamber filled with the paint from one end side thereof and supplied with air from the other end side thereof;

a piston movably disposed in said storage chamber;

a rod extending from an end of said piston to the air feed side of said storage chamber and projecting from said storage chamber to the outside;

a hollow rod fixedly mounted on an outer peripheral wall of said rod, said hollow rod being axially movable relative to said rod;

an extension disposed between a cover defining the air feed side of said storage chamber and said piston, said extension being mounted on said hollow rod and engageable with said cover; and means mounted on said rod and said hollow rod, for detecting respective positions where said piston is reciprocatively moved.

9. An electrostatic spray painting apparatus according to claim 8, wherein said rod has a screw formed on the outer peripheral wall thereof and said hollow rod has a screw channel defined in an inner peripheral wall thereof so as to be threadedly engaged with said screw.

10. An electrostatic spray painting apparatus according to claim 8, wherein said detecting means on said rod and said hollow rod include a pair of dogs which can be held in engagement with a pair of sensors respectively when said piston reaches an uppermost advanced position and a lowermost withdrawal position.

11. An electrostatic spray painting apparatus comprising:

an electrically-insulated intermediate reservoir for storing therein conductive paint to which a high voltage is directly applied;

a pressurized-air feed mechanism for supplying pressurized air to said intermediate reservoir so as to deliver the paint in said intermediate reservoir to a spray gun;

a vent mechanism for discharging the pressurized air to the outside from said intermediate reservoir after completion of the supply of the paint to the spray gun; and a dew-condensation prevention mechanism for preventing said vent mechanism from being subjected to dew condensation.

12. An electrostatic spray painting apparatus according to claim 11, wherein said dew-condensation prevention mechanism includes an air feed source for supplying dry air to the outer face of said vent mechanism.

13. An electrostatic spray painting apparatus according to claim 11, wherein said dew-condensation prevention mechanism includes a heat insulating material mounted on the outside of said vent mechanism.

14. An electrostatic spray painting apparatus according to claim 11, wherein said dew-condensation prevention mechanism includes heating means mounted on said vent mechanism.

* * * * *